US005447446A

United States Patent [19]

Miller

[11] Patent Number: 5,447,446

[45] Date of Patent: Sep. 5, 1995

[54] ELECTRICAL CONNECTOR COMPONENT HAVING SECURED SEAL

[75] Inventor: Steven D. Miller, Spartanburg, S.C.

[73] Assignee: Thomas & Betts Corporation, Memphis, Tenn.

[21] Appl. No.: 971,879

[22] Filed: Nov. 5, 1992

[51] Int. Cl.[6] ..... H01R 13/52

[52] U.S. Cl. ..... 439/281

[58] Field of Search ..... 439/278, 281, 587, 588, 439/279, 280, 282, 606, 589

[56] References Cited

U.S. PATENT DOCUMENTS

| | | | |
|---|---|---|---|
| 3,037,070 | 5/1962 | Sussman et al. | 174/152 |
| 3,594,696 | 7/1971 | Witek, Jr. | 439/278 |
| 4,006,210 | 2/1977 | Denton | 264/250 |
| 4,011,819 | 3/1977 | Kessler | 102/70.2 |
| 4,124,675 | 11/1978 | McFarlane | 264/249 |
| 4,328,972 | 5/1982 | Albertson et al. | 277/1 |
| 4,468,367 | 8/1984 | Beune et al. | 264/255 |
| 4,584,155 | 4/1986 | Zanella | 264/252 |
| 4,701,999 | 10/1987 | Palmer | 437/211 |
| 4,778,366 | 10/1988 | Weaver | 425/110 |
| 4,792,425 | 12/1988 | Weaver | 264/252 |
| 4,795,667 | 1/1989 | Armstrong | 428/77 |
| 4,839,122 | 6/1989 | Weaver | 264/129 |
| 4,865,793 | 9/1989 | Suzuki et al. | 264/278 |
| 4,915,395 | 4/1990 | Barteck | 277/12 |
| 4,961,713 | 10/1990 | McCracken et al. | 439/281 |
| 4,979,910 | 12/1990 | Revil et al. | 439/680 |
| 5,008,060 | 4/1991 | Kanai et al. | 264/255 |
| 5,252,088 | 10/1992 | Morello et al. | 439/271 |

*Primary Examiner*—Gary F. Paumen

*Attorney, Agent, or Firm*—Thomas & Betts Corp.

[57] ABSTRACT

An electrical connector component comprises a body member defining a compartment therein having an open end for the receipt of a mating electrical connector component, the body member further defining a recess adjacent the open end thereof, and a sealant for sealing engagement with said mating electrical connector component fixedly secured to the body member and resident in the recess. The body member further defines a mating surface located oppositely with respect to the open end and defines a further recess adjacent the mating surface, the sealant being resident also in the further recess. The sealant comprises a flowable material disposed in first part continuously interiorly of the body member adjacent the open end thereof and in second part continuously exteriorly of the body member adjacent the mating surface. Channels are provided in the body member extending into communication with the first and second recesses whereby a fluid flow-supporting path extends throughout the body member and the sealant material may be introduced into one recess and therefrom through the channels into the second recess.

13 Claims, 3 Drawing Sheets

ELECTRICAL CONNECTOR COMPONENT HAVING SECURED SEAL

FIELD OF THE INVENTION

This invention relates generally to electrical connectors and pertains particularly to apparatus and methods for providing sealing of electrical connectors against ambient environment.

BACKGROUND OF THE INVENTION

So-called "I/O Headers", i.e., input/output headers, are a typical component of electrical connectors, constituted of a body of electrically insulative material, generally rectangular in outline, with upstanding end walls and sidewalls extending between the end walls, the walls collectively defining therewithin a compartment for receipt of a mating plug, and a base or floor at the interior of the compartment and supporting electrical contact members, e.g., contact pins upstanding from the base to enter female contacts of the mating plug on insertion of the mating plug into the header. While what has been described is a male header, the industry also encompasses female headers, wherein the contacts of the mating plug are adapted for the receipt of contact pins extending outwardly of the mating plug.

Headers, themselves, are resident in such as a PCB (printed circuit board) or other support housing.

In various applications, it is imperative to provide sealing at respective mating surfaces, i.e., in the described header-mating plug-PCB instance, as between the header and the mating plug and as between the header and the PCB. Known headers do not themselves incorporate sealing facility. Sealing members are thus provided, separately from the header, to effect the requisite sealing as against ambient environment, e.g., ingress of moisture therefrom into the header.

Disadvantage attends the known practices in that sealing components need be inventoried separately from the headers, mating plugs and PCBs and in that connection assembly is labor-intensive in requiring steps of effecting sealing apart from simple mating of headers, mating plugs and PCBs. Further, sealing components which are provided separately from headers are subject to damage in handling and then suffer in effectiveness upon assembly with headers.

SUMMARY OF THE INVENTION

The present object has as its primary object the provision of improved electrical connector components.

A more particular object of the invention is to provide electrical connector components having seals therewith.

A specific object of the invention is to provide improved headers for sealed engagement with mating plugs through the use of seals combined fixedly with the headers.

A more specific object of the invention is to provide improved headers for sealed engagement with both mating plugs and PCBs through the use of seals combined fixedly with the headers.

In attaining the foregoing and other objects, the invention provides, in one instance of an apparatus aspect, an electrical connector component comprising a body member defining a compartment therein having an open end for the receipt of a mating electrical connector component, the body member further defining a recess adjacent the open end thereof, and a sealant for sealing engagement with said mating electrical connector component fixedly secured to the body member and resident in the recess.

The body member desirably further defines a mating surface located oppositely with respect to the open end thereof and a further recess adjacent the mating surface, the sealant being resident also in the further recess.

In a particularly preferred embodiment of the invention, the sealant comprises a material disposed in first part continuously interiorly of the body member in the recess adjacent the open end thereof and in second part continuously exteriorly of the body member in the recess adjacent the mating surface. Channels are provided in the body member extending into fluid-flow communication with the first and second recesses whereby a fluid flow-supporting path extends throughout the body member and the sealant may be introduced into one recess to flow therefrom throughout the one recess and through the channels into the second recess, the sealant being settable to form a seal secured fixedly to the body member. Silicone in fluid state and settable following such fluent state thereof to adhere fixedly to the body member is suitable as the sealant.

The invention further contemplates the provision of a connector component which defines recesses exteriorly of opposed ends thereof for residence of sealant and a channel providing communication between the recesses.

Method aspects of the invention provide the described connector component and are discussed in detail hereinafter.

The foregoing and other objects and features of the invention will be further understood from the following detailed description of preferred embodiments thereof and from the drawings, wherein like reference numerals identify like components throughout.

DETAILED DESCRIPTION OF PREFERRED EMBODIMENTS AND PRACTICES

Figure 1:
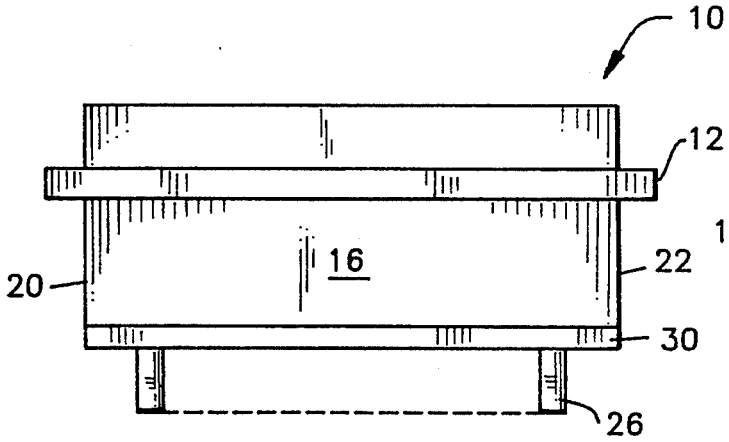
FIG. 1 is a front side elevation of a header in accordance with the invention.
Figure 3:
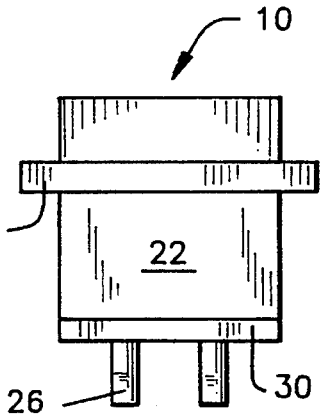
FIG. 3 is a right side elevation of the FIG. 1 header.
Figure 2:
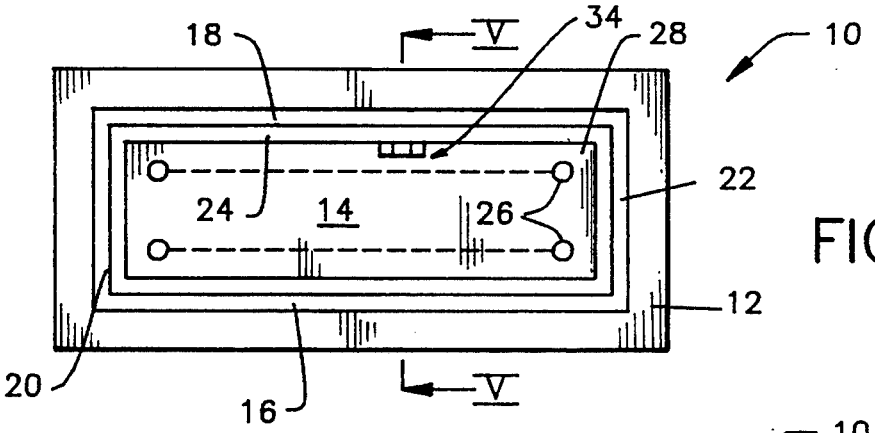
FIG. 2 is a top plan view of the FIG. 1 header.
Figure 4:
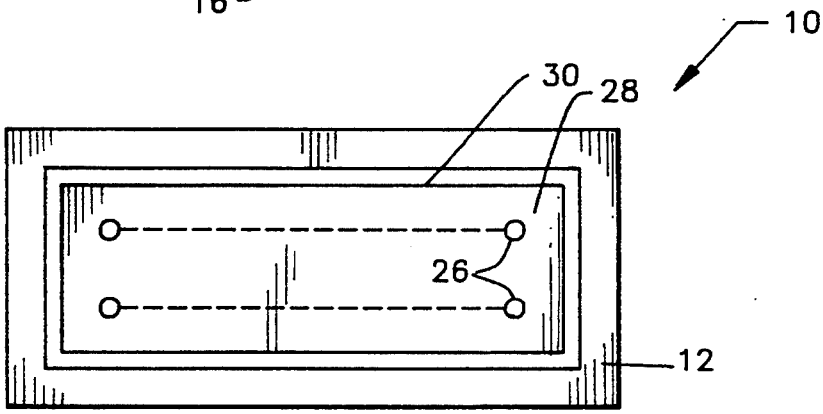
FIG. 4 is a bottom plan view of the FIG. 1 header.

Referring to FIGS. 1–4, header 10, typically a molded plastic unit, includes a body member having a mounting flange 12 and defining an open compartment 14, bounded by sidewalls 16 and 18 and end walls 20 and 22. A seal 24 is secured to upper regions of walls 16–22 and extends continuously around compartment 14 for purposes of effecting sealed receipt of a mating connector component (not shown).

Contact pins 26 are supported in header base or floor 28, extending therebelow for mating engagement with a PCB or the like (not shown) and extending upwardly of the base for mating engagement with complemental contacts of the mating connector.

A seal 30 is secured to header 10 at its underside and extends continuously around the header for purposes of effecting sealed communication in the connection of the header to the PCB.

Figure 5:
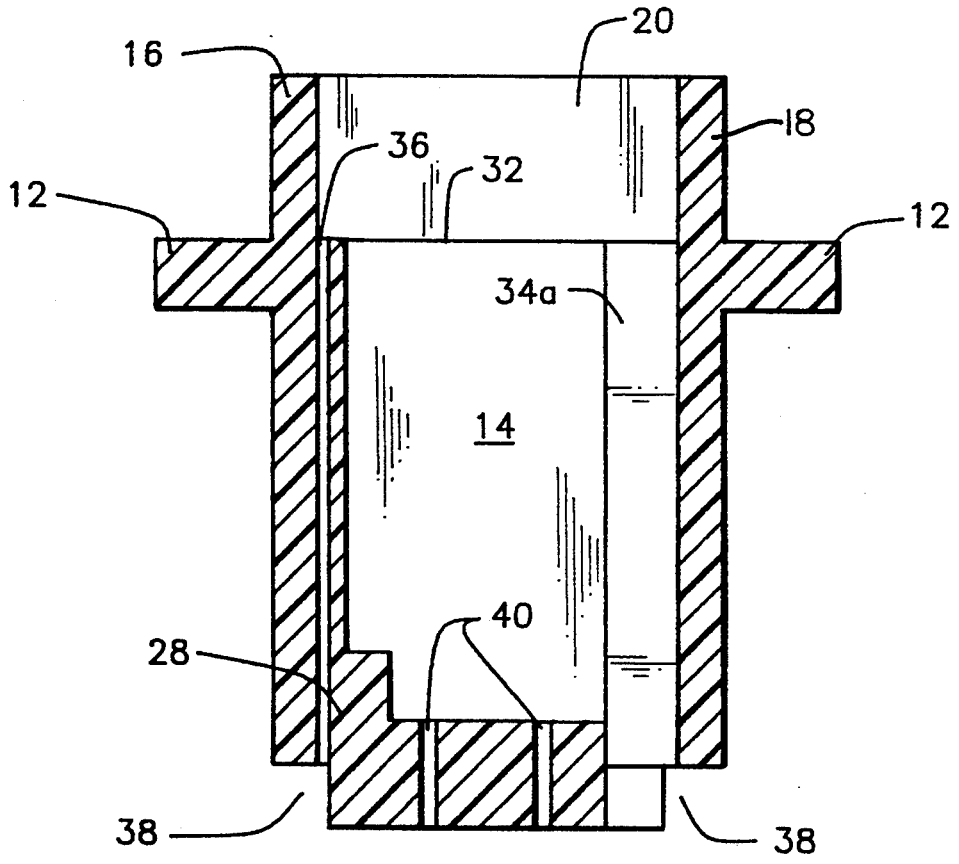
FIG. 5 is a sectional view of a body member of the FIG. 1 header would be seen from plane V—V of FIG. 2, prior to introduction of sealant therein.
Figure 6:
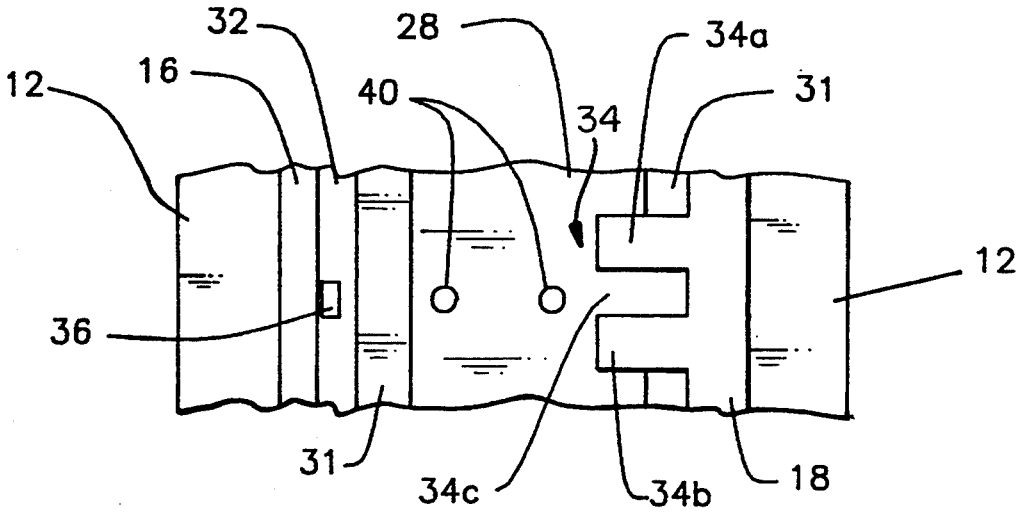
FIG. 6 is a partial top plan view of the FIG. 5 header body member.

FIGS. 5 and 6 depict the header body member with contacts 26 omitted and seals 24 and 30 not yet secured therewith. An upper cutout portion forming recess 31 leads to ledge 32. A polarization key 34 is formed on the interior of sidewall 18 and includes wings **34*a* and 34*b* and channel 34*c* formed between the wings and in flow communication with recess 31. A further channel 36 also communicates with recess 31 and extends interiorly of sidewall 16. Each of walls 16–20 is undercut to form recess 38, which extends continuously around base 28**.

Each of channels **34*c* and 36 is further in flow communication with recess 38. Contact pin passages 40** complete description of the header body member.

Figure 7:
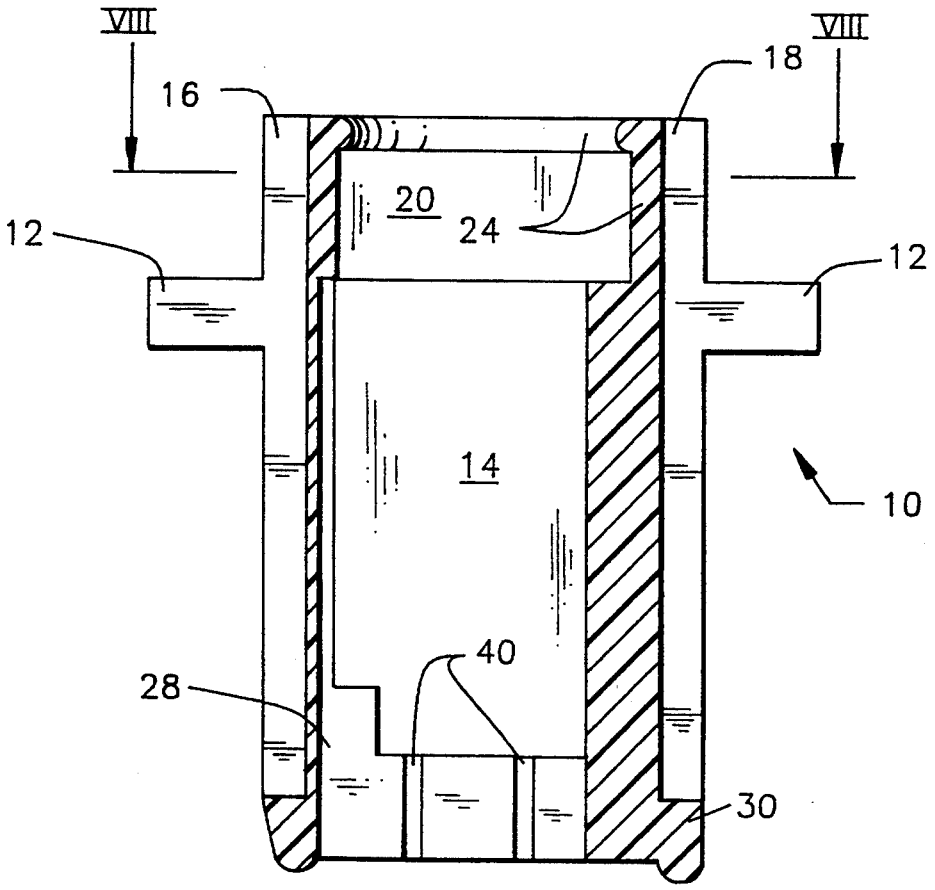
FIG. 7 is an enlarged repeat showing of FIG. 5, with sealant resident therein and shown in section, with sectioning for the body member omitted to enhance illustration of the sealant.
Figure 8:
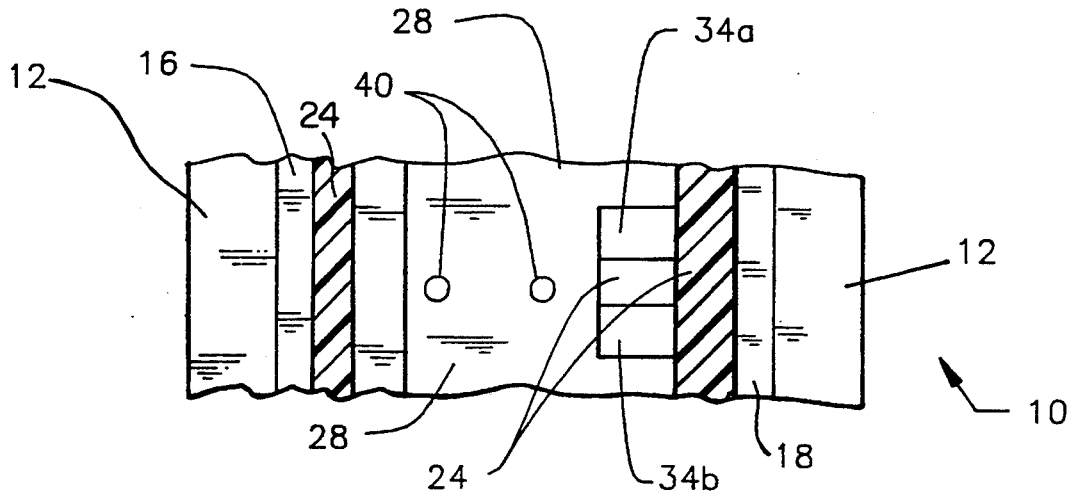
FIG. 8 is a partial sectional view of the header body member with sealant resident therein as would be seen from plane VIII—VIII of FIG. 7.

Referring to FIGS. 7 and 8, seals 24 and 30 will be seen to be both constituted by a common sealant, preferably silicone. In reaching the header with seals thus introduced, the header body member is placed in an exterior mold die conforming to the illustrated (sealant-inclusive) exterior of FIGS. 7 and 8. An interior mold die in introduced into compartment 14 and has a configuration adapted to form the sealant in conformity with the illustrated (sealant-inclusive) interior of FIGS. 7 and 8. Showings of the mold dies are not included since their structure will be appreciated as complemental to the showing of FIGS. 7 and 8.

A sealant input port is provided adjacent the upper portion of the interior mold die and an air escape vent is provided in the exterior mold die. The introduced sealant flows throughout recess 31, through channels **34*c* and 36 and throughout recess 38, thus providing the seal configuration of FIGS. 7 and 8**.

In further explanation of the invention in its method aspect and by way of introduction to the ensuing claims, the invention will be seen to provide a method for providing sealing as between a first electrical connector component, e.g., a header, and a second electrical connector component, e.g., a mating plug, involving the steps of configuring the first electrical connector component as a body member defining a compartment therein having an open end for the receipt of the second electrical connector component and a recess extending from the open end interiorly of the compartment and about the interior periphery of the body member and securing sealant material in the recess. The recess is desirably configured to extend continuously about the interior periphery of the body member.

In reaching the particular type of component discussed above, the applicable steps are configuring the first electrical connector component as a body member defining a compartment therein having an open end for the receipt of the second electrical connector component and having a substantially closed end opposite the open end, a first recess extending from the open end interiorly of the compartment and about the interior periphery of the body member and a second recess extending about the periphery of the body member opposite end and open exteriorly of the body member and securing sealant material in each of the first and second recesses.

The first recess is configured to extend continuously about the interior periphery of the body member and wherein the second recess is configured to extend continously about the periphery of the body member opposite end. The body member is further configured to have a channel extending from the first recess to the second recess and opening into each of the first and second recesses. The body member is also configured to have a polarization member and one of the channels is formed in the polarization member.

While the channels **34*c* and 36 are shown in FIGS. 5 and 6** as being disposed along the same section of the body member, they may of course be disposed in mutually different sections of the body member.

In its apparatus aspect, the invention will be seen to provide an electrical connector component comprising a body member defining a compartment therein having an open end for the receipt of a mating electrical connector component, the body member further defining a recess adjacent the open end thereof, and sealing means for sealing engagement with the mating electrical connector component, the sealing means being fixedly secured to the body member and resident in the recess. The component may further define a mating surface located oppositely with respect to the open end and a further recess adjacent the mating surface, the sealing means being resident also in the further recess.

The sealing means may comprise a sealant material disposed in first part continuously interiorly of the body member adjacent the open end thereof and in second part continuously exteriorly of the body member adjacent the mating surface. Further, the sealant material may be disposed in third part interiorly of the body member contiguously with the sealant material first and second parts. The body member desirably defines a key structure for polarized receipt of the mating electrical connector component and the sealant material third part is resident at least in part interiorly of the key structure. The body member includes a plurality of walls bounding its compartment, at least one of the walls providing a channel also for residence of the sealant material third part.

Various changes in structure to the described connector component and practices for effecting connection of electrical components may evidently be introduced without departing from the invention. By way of example, the invention may be practiced with both ends of the connector component defining compartments for receipt of mating plugs, in which case compartment 14 and seal 24 are formed at each end of the connector component, with channels for sealant flow interconnecting recesses 31 formed interiorly of the both ends. Likewise, the invention contemplates the provision of recesses 38 and seals 30 at both ends of a single connector component with channels for sealant flow interconnecting the recesses 38. The invention further contemplates the molding of further seals on the upper and lower surfaces of mounting flange 12 whereby it also may be in sealed relation with companion apparatus mounting surface. As noted, while the depicted embodiment employs male contact pins, connector components in accordance with the invention may employ female contact members. Accordingly, it is to be understood that the particularly disclosed and depicted embodiment is intended in an illustrative and not in a limiting sense. The true spirit and scope of the invention are set forth in the following claims.

What is claimed is:

1. An electrical connector component comprising a body member defining a compartment therein having an open end for the receipt of a mating electrical connector component, said body member defining an interior recess adjacent said open end thereof, said body member further defining a mating surface located oppositely with respect to said open end and defining an exterior recess adjacent said mating surface, a sealant material disposed in first part continuously interiorly of said body member in said interior recess, in second part continuously exteriorly of said body member in said exterior recess, and in third part interiorly of said body member continuously with said sealant material first and second parts, said body member defining a key structure for polarized receipt of said mating electrical connector component, said sealant material third part being resident at least in part interiorly of said key structure to form a part of said key structure.

2. The invention claimed in claim 1 wherein said body member includes a plurality of walls bounding said compartment, at least one of said walls providing a channel for residence of said sealant material third part.

3. The invention claimed in claim 1 wherein said sealant material is selected to be silicone.

4. A sealed header comprising:

an insulative body member including a base, a pair of spaced sidewalls and a pair of spaced endwalls upstanding from said base, said spaced sidewalls and endwalls defining a compartment having an open end within said body member;

a plurality of electrically conductive contact pins supported by said base, a portion of said pins extending within said compartment for mating engagement with complemental contacts of a mating connector and a portion of said pins projecting outwardly for connection to an electrical component;

an interior seal disposed continuously on interior surfaces of said sidewalls and endwalls adjacent said compartment open end and spaced from said contact pins, said interior seal adapted to provide sealed receipt of said mating connector; and an exterior seal disposed on an exterior surface of said body member adjacent said base and continuously around the periphery thereof, said exterior seal being spaced from said pins and adapted to provide sealed communication with said electrical component.

5. A sealed header according to claim 4, wherein said body member defines adjacent the open end of said compartment an interior recess in communication with said compartment, said interior seal being resident in said interior recess.

6. A sealed header according to claim 5, wherein said interior recess is defined by at least the interior surfaces of said spaced sidewalls.

7. A sealed header according to claim 5, wherein said body member defines adjacent the base an exterior recess, said exterior seal being resident in said exterior recess.

8. A sealed header according to claim 7, wherein said body member defines a channel in communication with said interior recess and said exterior recess.

9. A sealed header according to claim 8, wherein sealant material is disposed within said channel in communication with said interior seal and said exterior seal.

10. A sealed header according to claim 9, wherein said interior seal, said exterior seal and said sealant material are all formed continuously.

11. A sealed header according to claim 10, wherein said interior seal, said exterior seal and said sealant material are formed by a molding process.

12. A sealed header according to claim 4, wherein said body member further defines within said compartment a key structure for polarized receipt of said mating connector.

13. A sealed header according to claim 9, wherein said key structure defines a key channel in communication with said channel, said sealant material being resident in both said channel and said key channel.

* * * * *